US009747795B1

(12) United States Patent
Espinosa

(10) Patent No.: US 9,747,795 B1
(45) Date of Patent: Aug. 29, 2017

(54) SYSTEM TO ALERT USERS OF POTENTIAL AMBUSHERS

(71) Applicant: AEGIS Enterprises, LLC, Hialeah, FL (US)

(72) Inventor: Albert Espinosa, Miami, FL (US)

(73) Assignee: AEGIS Enterprises, LLC, Hialeah, FL (US)

( * ) Notice: Subject to any disclaimer, the term of this patent is extended or adjusted under 35 U.S.C. 154(b) by 0 days.

(21) Appl. No.: 15/369,401

(22) Filed: Dec. 5, 2016

(51) Int. Cl.
*G08G 1/00* (2006.01)
*G08G 1/0962* (2006.01)

(52) U.S. Cl.
CPC ..... *G08G 1/0962* (2013.01)

(58) Field of Classification Search
CPC ... B60R 25/102; B60R 25/104; B60R 25/305; B60R 25/33; B60R 2025/1013; G08B 25/016; G08G 1/0962
USPC ..... 340/426.1, 426.12, 426.18–426.24, 471, 340/541, 552, 554
See application file for complete search history.

(56) References Cited

U.S. PATENT DOCUMENTS 5,027,104 A * 6/1991 Reid ..... B60R 1/00 340/426.18
5,315,285 A * 5/1994 Nykerk ..... B60R 25/04 340/426.23
5,424,712 A * 6/1995 Rosenberger ..... B60R 25/10 340/541
5,515,285 A * 5/1996 Garrett, Sr. ..... B60R 25/102 340/426.2
5,905,431 A * 5/1999 Mueller ..... B60R 25/1003 340/426.17
6,002,326 A * 12/1999 Turner ..... B60R 1/00 340/426.12
2004/0021772 A1* 2/2004 Mitchell ..... B60R 25/102 348/148
2009/0273673 A1* 11/2009 Worley, III ..... B60R 25/102 348/148
2014/0168435 A1* 6/2014 Tuhro ..... B60Q 5/006 348/148
2014/0240111 A1* 8/2014 Kleve ..... G08B 25/016 340/426.18

* cited by examiner

*Primary Examiner* — Thomas Mullen
(74) *Attorney, Agent, or Firm* — Christian Sanchelima; Jesus Sanchelima

(57) ABSTRACT

The present invention provides an alert system for providing protection to the users inside the vehicle from potential intruders and ambushers. The alert system includes a proximity detection unit using microwaves to detect any potential ambusher in the vicinity of the vehicle, an alarm unit raises an alarm to alert the users of the vehicle of the potential ambusher(s), a warning unit to warn the potential ambusher to back away and a remote communication unit to broadcast a signal to a remote location to inform the personnel therein about the potential attack. The alert system also includes means to mitigate false alarms. Further, the alert system is capable to be retro-fitted into existing vehicles.

14 Claims, 6 Drawing Sheets

SYSTEM TO ALERT USERS OF POTENTIAL AMBUSHERS

BACKGROUND OF THE INVENTION

1. Field of the Invention

The present disclosure generally relates to an alert system for averting ambushers; and more particularly to an alert system for vehicles providing proximity detection, alarm generation and remote warning, in situation of an ambusher approaching the vehicle.

2. Description of the Related Art

It is often required for police personnel and other administrative officials to patrol unsafe regions with high crime rates during the course of their duties. Many times, they have to stay there all night to actively monitor, report and, if necessary, to take action against any suspected activities occurring in those areas. In such unsafe regions, these officials are, generally, at a risk of facing some kind of attack by criminals. That is why they are advised to stay inside their vehicles while being in such regions to avoid any unwarranted situation that may arise. Staying inside the vehicle may provide some level of security to these officials against direct attack by the criminals. Further, being inside the vehicle, they may could be more prepared to respond in case of an attack by quickly driving out of the targeted area to a safe area. However, many times staying inside the vehicle may not be sufficient to circumvent risk of attack, for example in the event of a surprise ambush attack. The ambushers may exploit the limitation of the users inside the vehicle, as staying inside the vehicle limits their ability to monitor their surroundings. These criminals may try to mount a surprise attack by surrounding the vehicle with the users therein and ambushing them when most unexpected.

There are some alert systems known which help securing a defined area from unauthorized access. For example, there are home alarm systems which detect unauthorized intrusion by detecting any person trying to climb the fence of the house and raising an alarm. Further, there are alert systems for vehicles, which generate alarms when unauthorized persons try opening a door or a window of a vehicle. However, such systems may not be capable to determine potential ambushers in the vicinity of the vehicle. Some known systems which are capable of detecting the possible ambushers in vicinity of the vehicle, are generally very expensive and usually come pre-installed with the vehicle. There are no inexpensive and easily available systems which could be retrofitted to existing vehicles and which can help secure mobile vehicles by alerting the user inside the vehicle of potential ambushers in vicinity of the vehicle and further warning the support units of possible attack so they can be readily deployed to aid the users of the vehicle under attack.

Applicant believes that a related reference corresponds to U.S. Pat. No. 5,315,285 A (hereinafter referred to as '285 patent), which discloses an alarm system that senses the presence of a person sufficiently near a protected object, such as an automobile, to inflict damage thereto, and provides verbal warnings to the person. The alarm system of the '285 patent includes a proximity detector that senses the proximity of a person to the protected object and means for generating vocal signals using electronic speech generation circuits. Such vocal signals typically instruct the person to back away from the protected object, thereby preventing the person from inflicting any damage to the object. The alarm system of the '285 patent is based on motion detection sensors which may not generally be very reliable, as these could produce false alarms by construing the motion of unharmful animals or static objects, such as walls, as potential attack.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an alert system which can detect any potential ambusher in the vicinity of a vehicle.

It is another object of this invention to provide an alert system which can raise an alarm to alert the users inside the vehicle about the potential ambushers.

It is still another object of this invention to provide an alert system which allows to selectively deactivate detection feature along certain sides of the vehicle to avoid false alarms.

It is still another object of the present invention to provide an alert system which can warn the potential ambusher to back away with a warning message.

It is still another object of the present invention to provide an alert system which can broadcast a signal to a remote location in case of the potential ambush situation.

It is yet another object of this invention to provide such an alert system that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively. Additionally, the words "herein," "above," "below", etc., when used in this application, shall refer to this application as a whole and not to any particular portions of this application. It should be noted that designations of "horizontal," "vertical," "longitudinal," "lateral," and the like are relative terms and may be interchanged consistently while adhering to the concepts of the present invention.

Figure 1:
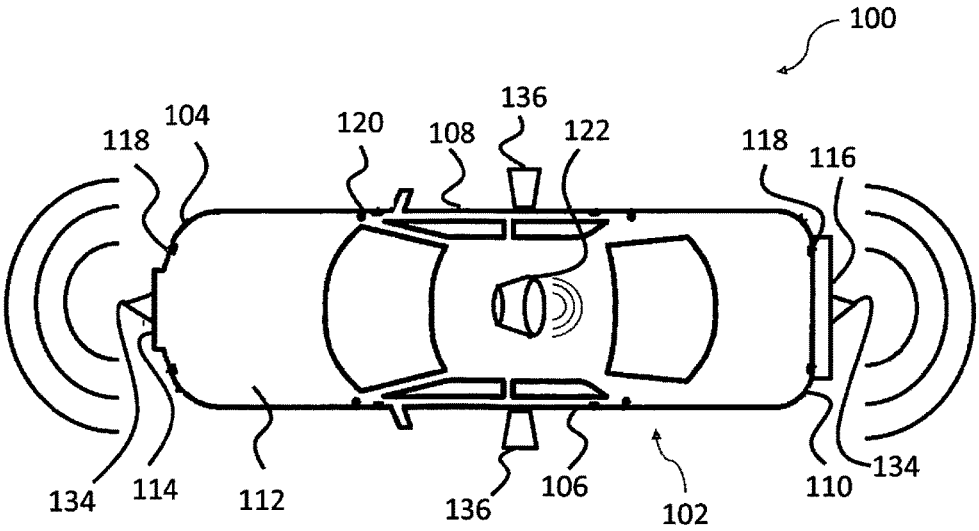
FIG. 1 illustrates a top view of a vehicle incorporating an alert system, in accordance with one or more embodiments of the present disclosure.

FIG. 1 illustrates a vehicle 100 incorporating an alert system 102 of the present invention. In FIG. 1, the vehicle 100 is shown in the form of a regular police patrol car; however, in accordance with various embodiments of the present invention, the vehicle 100 may include, but not limited to, cars, motorcades, coaches, trucks, motorcycles, buses, trains, boats, airplanes, and the like. Hereinafter, the terms "vehicle," "car," "automobile," and variations thereof may be interchangeably used, without any limitation. The vehicle 100 may be any conveyance that may be used for the purpose of moving one or more person or objects. In some embodiments, the vehicle 100 may not necessarily be a moving object but also include a stationary object, such as, home, office space, factory, police station, etc.

As illustrated in FIG. 1, the vehicle 100 may include a front portion 104, a left-side portion 106, a right-side portion 108, and a rear portion 110. The vehicle 100 may further include other conventional systems and accessories including, but not limited to, a hood 112, a front bumper 114, a rear bumper 116, pairs of front headlights and taillights 118, a pair of side indication lights 120, etc. In some examples, the vehicle 100 may be fitted with bullet-proof glasses for its windows and panels, and further have reinforced materials and joints used throughout. In one embodiment of the present invention, the vehicle 100 may be fitted with a loudspeaker device 122 or the like, which may usually be mounted on a top of the vehicle 100. In other examples, the vehicle 100 being a police patrol vehicle may include siren lights (not shown) mounted on top which in addition to generating loud sounds can also generate flashing lights in various colors to respond to various possible situations.

In accordance with one or more embodiments, the vehicle 100 is fitted with the alert system 102 of the present invention. The alert system 102 may be in communication with different systems of the vehicle 100 via various communication buses (not shown). For example, the alert system 102 may be integrated with door locks (not shown), the loudspeaker device 122 or the siren lights of the vehicle 100 in order to activate or deactivate the said systems, as required. In some examples, the alert system 102 may be powered by the power system, such as, the battery (not shown), of the vehicle 100 itself. In other examples, the alert system 102 may include a standalone power source for powering its components. It may be understood that the alert system 102 of the present invention may be integrated with the other components of the vehicle 100 while the vehicle 100 is assembled in the factory or the like, or the alert system 102 may be retrofitted in an existing car, such as the vehicle 100 as discussed in detail later in the description.

Figure 2:
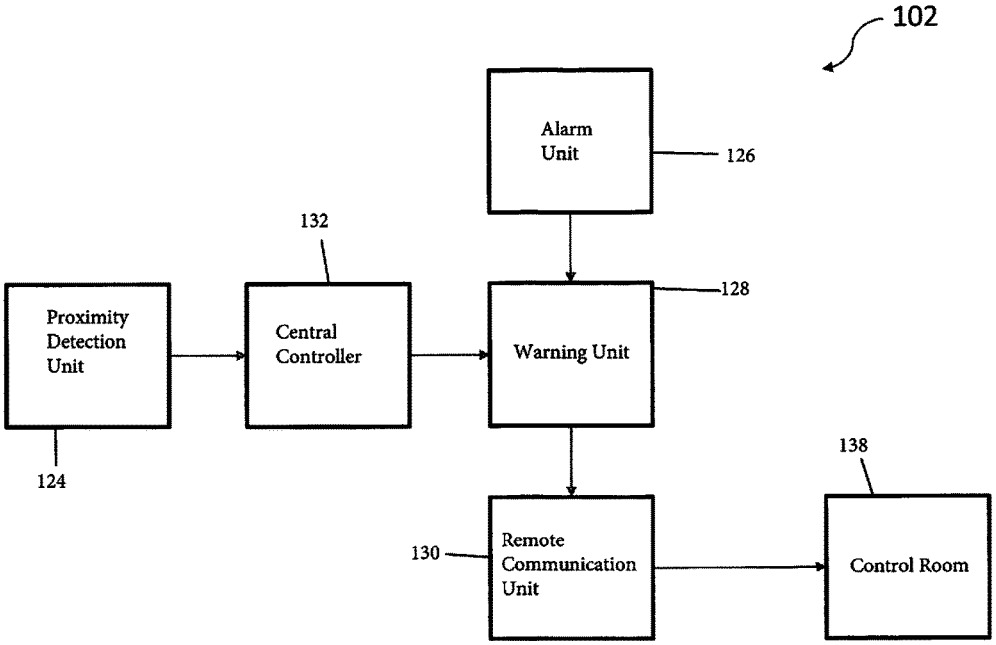
FIG. 2 illustrates a schematic diagram of the alert system of FIG. 1.
Figure 3:
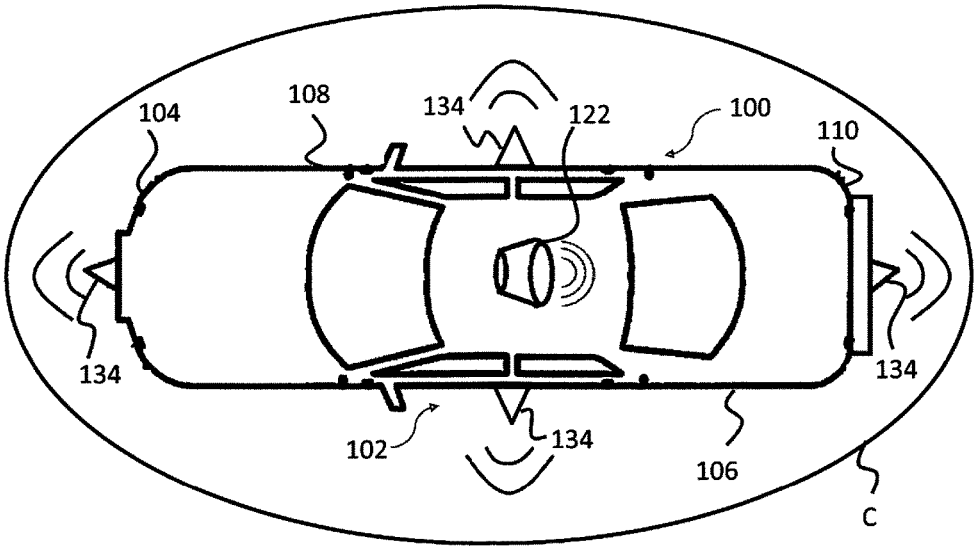
FIG. 3 is a representation of the present invention showing a proximity radius, "C", around the car and includes sensors 134 on both sides, helping create a 360-degree proximity radius.
Figure 3A:
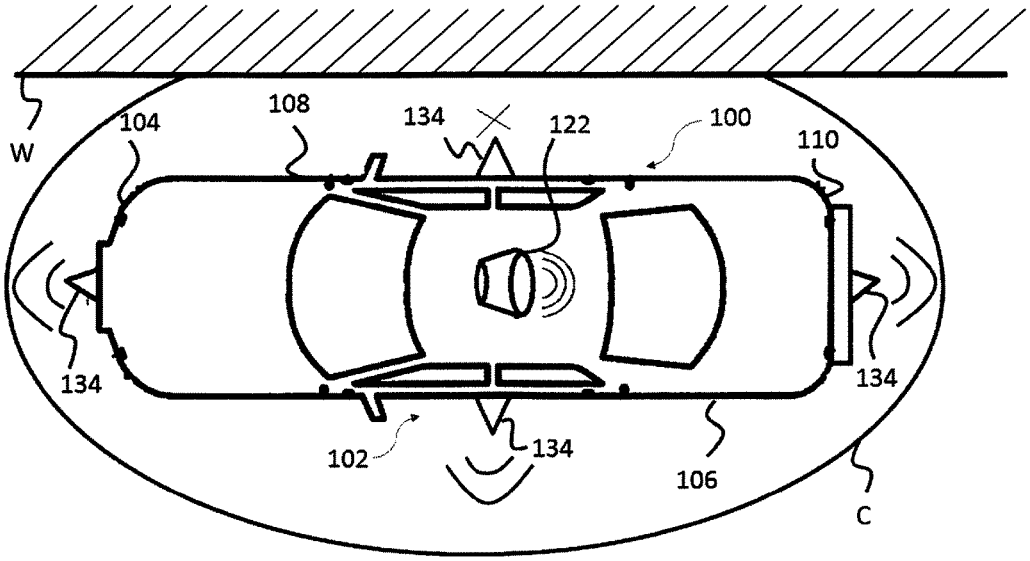
FIG. 3A depicts a top view of the operating environment of the present invention that is the same as FIG. 3 but now the car is up next to a wall and the proximity radius is only on 3 sides around car. The sensor on the side the wall is located is shown deactivated.
Figure 4:
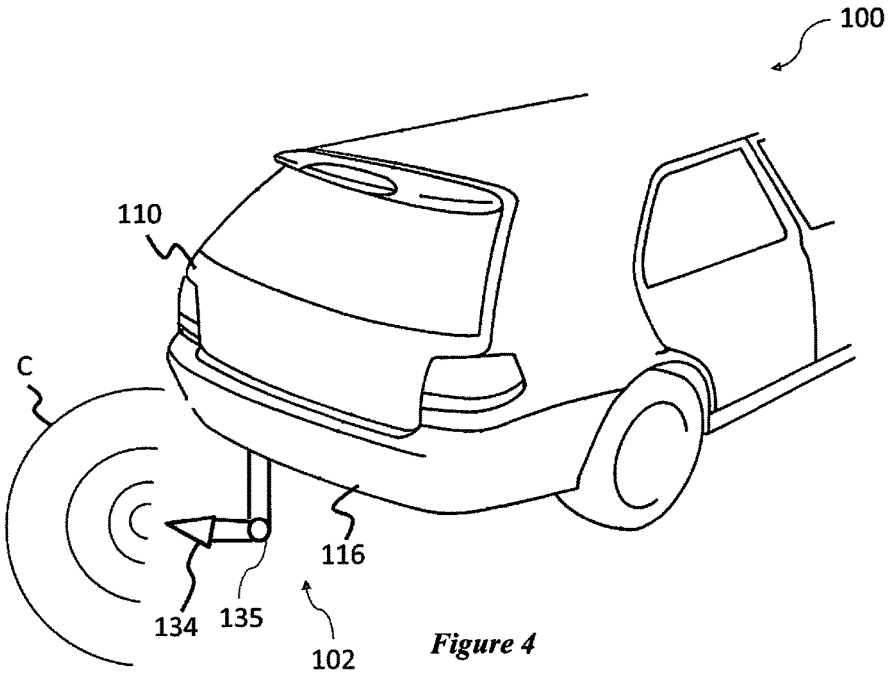
FIG. 4 is an isometric enlarged view of the rear of the vehicle showing a sensor 134 mounted under the rear bumper 116 using pivoting brackets 135 and tilted upwards to enlarge the pivot radius.
Figure 4A:
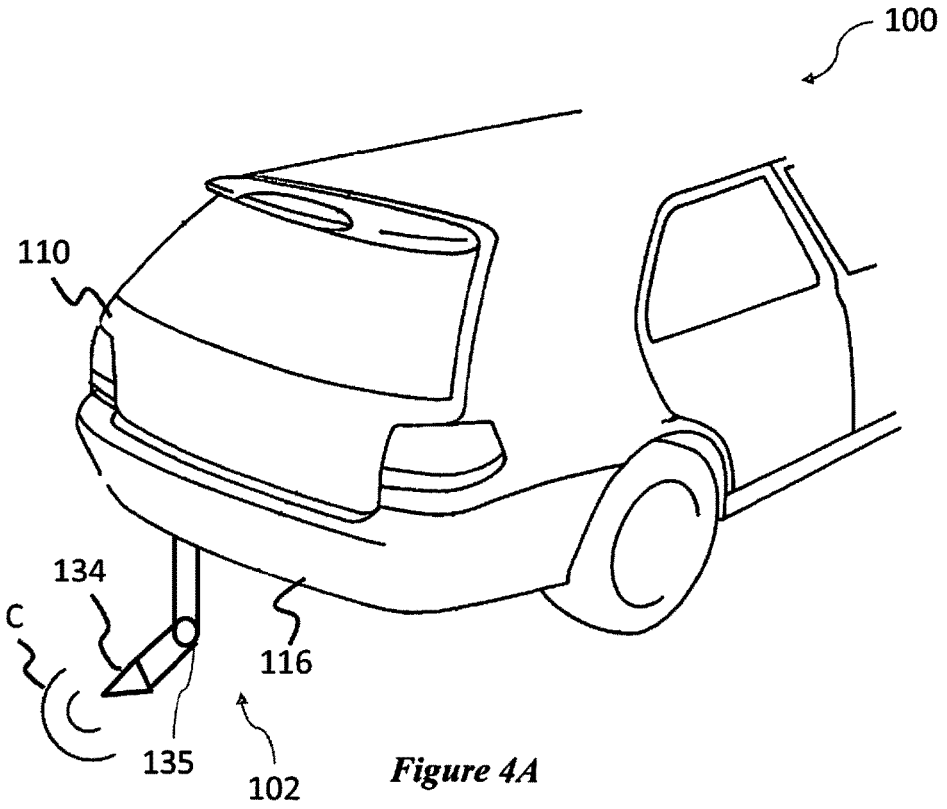
FIG. 4A is the same as FIG. 4 but now the pivoting bracket is tilted downwards to reduce the size of the proximity radius.

In general, the alert system 102 of the present invention includes a proximity detection unit 124, an alarm unit 126, a warning unit 128 and a remote communication unit 130. FIG. 2 illustrates a schematic of the alert system 102 showing the connection between its various units. The proximity detection unit 124, of the alert system 102, is configured to detect any potential ambusher in the vicinity of the vehicle 100. The alarm unit 126, of the alert system 102, is configured to raise an alarm to alert the user(s) inside the vehicle 100 of potential ambushers approaching the vehicle 100. The warning unit 128, of the alert system 102, is configured to warn the potential ambusher to back away with a warning message. The remote communication unit 130, of the alert system 102, is configured to broadcast an SOS signal to a remote location, including a police station, in case of the potential ambush. In addition, the alert system 102 may include a central controller 132 which co-ordinates between the various units thereof.

In one embodiment, the proximity detection unit 124 may be based on the principle of Doppler effect. In a preferred embodiment, microwaves are used to define a radius around the vehicle within which an unauthorized person cannot pass. The proximity detection unit 124 may generally include a plurality of sensors 134 (as illustrated in FIG. 1) mounted on one or more suitable locations of the vehicle 100, such as the front portion 104, the left-side portion 106, the right-side portion 108, and the rear portion 110. In one example, as illustrated in FIG. 1, the sensors 134 may, particularly, be mounted on the front bumper 114 and the rear bumper 116 of the vehicle 100; however, it may be contemplated by a person skilled in the art that such sensors 134 may have the required specifications to cover the entire perimeter around the vehicle 100 up to a desired distance, such as 5 to 10 feet. The sensors 134 may detect a moving object by transmitting a microwave and measuring a change in frequency, energy, or the like of a reflected wave from an object. When the sensors 134 detects a moving object approaching towards the vehicle 100, the proximity detection unit 124 transmits this information related to the moving object to the central controller 132. The proximity detection unit 124 can also lock the doors of the vehicle and emit an audible and visual alarm signal.

According to one embodiment of the present invention, the proximity detection unit 124 may be able to provide the user of the vehicle 100 with the ability selectively control the various sensors 134. For example, the proximity detection unit 124 may allow the user to deactivate the sensors 134 of a certain portion of the vehicle 100. For example, in a case when the vehicle 100 is parked next to a wall, the proximity detection unit 124 may deactivate the sensors 134 mounted on the side of the vehicle 100 which is placed next to the wall "W" in order to avoid frivolous alarms. In other cases, the proximity detection unit 124 may intelligently deactivate the sensors 134 mounted on the side of the vehicle 100 when found next to the wall without human intervention.

In one embodiment, the central controller 132 may be embedded with algorithms which can distinguish between unharmful movements, say of stray cat or the like and potentially dangerous movements, such as that of a person carrying some form of weapon. The central controller 132 analyzes the moving object information and on the basis of the analysis, determines whether the moving object is a person, for example based on a size or a shape of the object in question. This way the alert system 102 of the present invention may be able to determine potential ambushers approaching the vehicle 100, in advance. The central controller 132 may employ techniques such as, image recognition, machine learning, neural nets, etc. for this purpose. For example, the central controller 132 may communicate through a communication network to a server (not shown) which may represent a cloud computing system or cloud storage that allows the central controller 132 to either gain access to further computing capabilities or to storage at a location outside of the vehicle 100. The central controller 132 and the server may include a computer processor, memory and other required components, and be similar to any computing system as understood to one skilled in the art.

In some examples, the vehicle 100, like most modern vehicles, may be fitted with cameras 136 on all sides thereof, to provide a 360° panoramic view of outside of the vehicle 100; although in the illustration of FIG. 1 only two cameras 136 are shown because of space constraints, installed on the left-side and right-side portions 106, 108 of the vehicle 100. In such case, the alert system 102 may further use the feed of such cameras 136 in conjunction with a face-detection technology, via the central controller 132, to identify potential criminals, by matching the photos taken of the person outside of the vehicle 100 with a criminal database; and thereby providing more reliable detection results for potential ambushers. In some cases, the cameras 136 alone, in conjunction with the image recognition technology, may be employed in place of the sensors 134 for proximity detection. In one embodiment of the present invention, the central controller 132 may be configured to generate a detect signal in the event of detection results providing substantially positive indication for presence of potential ambushers.

The alarm unit 126 is provided in communication with the central controller 132 to receive the detect signal. In event of detection of potential ambusher around the vehicle 100 by the central controller 132 as confirmed by the receipt of the detect signal, the alarm unit 126 may warn the user(s) inside the vehicle 100 about the potential ambush situation. In one embodiment, the alarm unit 126 may include a buzzer (not shown) mounted inside the vehicle 100 that generates a loud sound in order to warn the user(s). In one example, the buzzer or beeper is an audio signaling device, that can be mechanical, electromechanical, or piezoelectric.

In the case of a piezoelectric buzzer, it receives a small current in the form of the detect signal, which in turn applies a mechanical pressure to the piezoelectric material inside, which in turn, thereby, generates the loud sound. In some examples, the alarm unit 126 may be configured to generate the alert sound in a gradually increasing loudness, with loudness increasing in relative proportion as the intruder/ambusher approaches closer and closer to the vehicle 100.

In one or more embodiments, the alarm unit 126 may also include a display screen (not shown) mounted on a dashboard inside the vehicle 100. The term "display screen" as used herein, may be a single window screen or a multi-window screen capable of displaying feeds from the various cameras 136 to the user inside the vehicle 100. Further, the term dashboard as used herein, may be any panel and/or area of the inside of the vehicle 100 disposed adjacent to the user. In case of receipt of the detect signal, the alarm unit 126 may be configured to highlight or focus on the display feed from relevant camera(s) 136 which helps the user to assess the potential ambush situation.

Similarly, the warning unit 128 is provided in communication with the central controller 132 to receive the detect signal. In event of detection of potential ambusher around the vehicle 100 by the central controller 132 as confirmed by the receipt of the detect signal, the warning unit 128 provides a warning to the potential ambusher(s) to back away. For example, the warning unit 128 may be integrated with the loud speaker device 122 or the siren lights of the vehicle 100. Upon receipt of the detect signal, the warning unit 128 may activate the loud speaker device 122 to generate a pre-recorded vocal message, such as "BACK-AWAY" or the like in respective regional language, or allow the user to use a microphone provided inside the vehicle 100 to speak a warning message. The warning unit 128 may also be configured to generate loud sounds external to the vehicle 100 in case of receipt of the detect signal, to disrupt the ambusher(s) from mounting a surprise attack on the vehicle 100. Further, in some examples, the warning unit 128 may start rapidly blinking the pairs of taillights 118, and side indication lights 120 in order to visually inform any help nearby.

Further, the remote communication unit 130 is provided in communication with the central controller 132 to receive the detect signal. In event of detection of potential ambusher around the vehicle 100 by the central controller 132 as confirmed by the receipt of the detect signal, the remote communication unit 130 establishes a communication connection with a control room 138 that may be located in a facility that is not within physical proximity to the vehicle 100, such as with the control room located in the nearest police station with respect to the location of the vehicle 100. The remote communication unit 130 may broadcast the emergency signal to the control room 138. This way, the alert system 102 may be able to warn the support units in the control room 138 of possible attack to the vehicle 100, so they can be readily deployed to send a backup unit to aid the users of the vehicle 100 under attack.

The remote communication unit 130 may have a local area communication capability and/or a wide area communication capability. For example, the remote communication unit 130 may communicate through a wireless system including one or more of, but not limited to, a cellular communication, satellite telephone communication, or other types of communication capabilities. Further, the remote communication unit 130 may have the capability for data communication, for example, using GSM, EDGE, LTE or the like, to further communicate location coordinates of the vehicle 100 to the control room 138. It may be understood that the location of the vehicle 100 may be determined by satellite positioning systems, such as the Global Positioning System ("GPS") (US), Global Navigation Satellite System ("GLONASS") (Russia), Galileo positioning system (EU), Compass navigation system (China), and Indian Regional Navigational Satellite System ("IRNSS") (India).

In some examples, the alert system 102 may be provided with recording units (not shown) which may record the activity around the vehicle 100 by using the cameras 136 and send that video feed to the control room 138 which may be manually analyzed, and if necessary the control room 138 may send a message to the user of the vehicle 100, via the remote communication unit 130, to alert the user of any potential ambush. In some more examples, the alert system 102 may work with the door locks and window motors of the vehicle 100 in case of potential ambush attack, as confirmed by the generation of the detect signal, to automatically lock the doors and lift the windows completely up to secure the users inside the vehicle 100 from external factors.

In some examples, the alert system 102 of the present invention may further be supplemented with some defensive equipment installed on the vehicle 100. For example, the alert system 102 may be integrated with high intensity strobe/flash lights (not shown) which could be activated on generation of the detect signal to temporarily blind the approaching ambusher(s) in the vicinity of the vehicle 100, in order for the user of the vehicle to have some time to drive out of the location under attack. In other examples, the alert system 102 may be integrated with a smoke generation device that may fill the area around the vehicle 100 with smoke to let the vehicle 100 to escape the ambush situation.

In some other possible examples, the vehicle 100 may be a vehicle with self-driving capabilities which in the event of ambush attack, as determined by the central controller 132, may intervene to drive the passengers of the vehicle 100 to a safe location; for example, in situation of kids sitting in back of the vehicle 100 and the driver/parents not therein and the kids under potential kidnapping attempt; and further the alert system 102 may inform the driver/parent by sending a message/notification on their respective configured smartphone or the like about this new safe location where the vehicle 100 is waiting.

As mentioned, the alert system 102 of the present invention may be easily retro-fitted in existing vehicles, such as the passenger cars. Retrofitting may require to install the sensors 134 near the front bumper 114 and the rear bumper 116 of the vehicle 100, routing the corresponding wires possibly under the hood 112 and into the communication hub (not shown) of the vehicle 100 which are already present in most modern vehicles. The other components of the alert system 102, such as the loud speaker device 122, the cameras 136, the buzzer, the display screen, etc. may be installed in a conventional manner.

Although the alert system 102 of the present invention has been described in terms of its implementation with the vehicle 100, it may easily be contemplated by a person skilled in the art that this in no way may limit its implementation to such police patrol vehicles; and the alert system 102 may be installed in homes, office spaces, factories, police stations, or any other possible building premises which may have the risk of intruders or ambush, for providing security to the occupants of the premises.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An alert system for providing protection to users inside a vehicle, comprising a proximity detection unit including a plurality of sensors that use microwaves to define a proximity radius within which an unauthorized person is not permitted to enter, a power source, a central controller unit, a warning unit connected to said proximity detection unit that actuates light sources and sound sources to warn said unauthorized person to leave said proximity radius upon it being entered, said vehicle's doors being locked and said vehicle's windows being raised upon the unauthorized person entering said proximity radius, a remote communication unit located within the vehicle and communicating with one or more remotely located entities, a plurality of cameras mounted at predetermined points along the vehicle, wherein said plurality of sensors can be individually activated or deactivated by said users and are mounted to the vehicle using brackets that can be pivoted to different angles with respect to the ground, and wherein said proximity radius is increased or decreased depending on the angle between the plurality of sensors and the ground.

2. The alert system of claim 1 wherein said alert system is retrofitted into existing vehicles.

3. The alert system of claim 1 wherein a display unit is mounted within said vehicle and displays the visual images provided by said plurality of cameras.

4. The alert system of claim 1 wherein said remote communication unit sends a notification to a police dispatcher alerting them of the vehicle's proximity radius being entered.

5. The alert system of claim 1 wherein a live feed from said plurality of cameras is sent to and viewable by persons at a police station upon the proximity radius being breached.

6. The alert system of claim 1 further including a smoke generation unit that emits an effective amount of smoke around the vehicle to obstruct the vision of the unauthorized person.

7. The alert system of claim 1 wherein said lights include strobe lights that temporarily impair the vision of said unauthorized person.

8. The alert system of claim 1 wherein said sounds are at a decibel level strong enough to temporarily impair the movement of said unauthorized person.

9. The alert system of claim 1 wherein said sounds are created using a piezoelectric buzzer.

10. The alert system of claim 1 wherein said central controller unit operates a self-driving function of said vehicle to move it to a safer area upon said proximity radius being breached.

11. The alert system of claim 1 wherein said plurality of cameras provide a user with a 360-degree view around the vehicle.

12. The alert system of claim 1 wherein said proximity detection unit automatically deactivates certain sensors depending on camera and sensor information being transmitted to it.

13. The alert system of claim 12 wherein said central controller unit communicates through a communication network and includes a computer processor, a server, memory, at least one programmable database, and an interface displayed through a display unit.

14. The alert system of claim 1 wherein said central controller unit includes instructions to distinguish between unharmful movements and potentially dangerous movements, said central controller analyzes a moving object to determine whether the moving object is a person using image recognition, machine learning, or neural nets.

* * * * *